United States Patent [19]

Lacoste

[11] 4,366,959

[45] Jan. 4, 1983

[54] RACKET FOR TENNIS AND SIMILAR GAMES

[75] Inventor: François R. Lacoste, Hauts-de-Seine, France

[73] Assignee: Patentex (Societe Anonyme), Fribourg, Switzerland

[21] Appl. No.: 234,989

[22] Filed: Feb. 17, 1981

Related U.S. Application Data

[63] Continuation-in-part of Ser. No. 78,497, Sep. 24, 1979, which is a continuation-in-part of Ser. No. 881,046, Feb. 24, 1978, abandoned.

[30] Foreign Application Priority Data

| | | | |
|---|---|---|---|
| Aug. 3, 1977 | [FR] | France | 77 06718 |
| Aug. 3, 1977 | [FR] | France | 77 06719 |
| Nov. 21, 1977 | [FR] | France | 77 34877 |
| Oct. 11, 1978 | [FR] | France | 78 29021 |

[51] Int. Cl.[3] ..... A63B 51/00

[52] U.S. Cl. ..... 273/73 D

[58] Field of Search ..... 273/73 R, 73 C, 73 D, 273/73 E

[56] References Cited

U.S. PATENT DOCUMENTS

| | | | |
|---|---|---|---|
| 455,632 | 7/1891 | Malings | 273/73 D |
| 1,733,960 | 10/1929 | Godfrey | 273/73 D |
| 2,626,804 | 1/1953 | Robinson | 273/73 D X |
| 4,118,029 | 10/1978 | Septier | 273/73 D |
| 4,231,575 | 11/1980 | Kutt et al. | 273/73 D |

FOREIGN PATENT DOCUMENTS

| | | | |
|---|---|---|---|
| 855902 | 2/1940 | France | 273/73 D |
| 28203 | of 1907 | United Kingdom | 273/73 D |

*Primary Examiner*—Anton O. Oechsle

*Attorney, Agent, or Firm*—Merriam, Marshall & Bicknell

[57] ABSTRACT

A racket for tennis and similar games in which the density of the strings in the central part of the strung surface is increased by incorporating a middle zone formed of a continuous length of stringing material, in which zone the strings are arranged in a pattern such that, at one of their ends, an adjacent pair of strings is immobilized relative to the frame at a common fixing point, while at their respective other ends, the strings are affixed to different fixing points. The pairs of strings having a common fixing point are not directly interconnected at the common fixing point, i.e., a path between one string affixed to a fixing point to which a second string is also affixed cannot be traced between the first string and the second string without passing through another fixing point. Only one interconnecting length of stringing material extends between adjacent fixing points.

4 Claims, 10 Drawing Figures

RACKET FOR TENNIS AND SIMILAR GAMES

This application is a continuation-in-part of application Ser. No. 78,497, filed Sept. 24, 1979, which is in turn a continuation-in-part of application Ser. No. 881,046, filed Feb. 24, 1978, now abandoned.

BACKGROUND OF THE INVENTION

This invention relates to a racket for use in tennis, squash and similar games, provided with a novel stringing pattern which not only improves the performance of the racket in play, but also increases the durability of the frame by distributing the forces created by the tension of the strings in a more uniform manner, thus tending to decrease the likelihood of breakage.

Although most tennis and similar rackets continue to be strung in the traditional manner, i.e., with a plurality of parallel main strings extending generally parallel to the longitudinal axis of the handle and a plurality of parallel cross-strings arranged perpendicularly to the main strings, there have been a number of proposals in which this pattern has been modified, with the objective of improving the performance of the racket, or increasing the durability thereof, or both. It is known, as exemplified in U.S. Pat. Nos. 644,877, 3,820,785, 3,999,756 and 4,013,289, to increase the effective resiliency of the stringing by increasing the relative density of the strings in the central portion of the striking surface, either by adding additional main or cross strings to a uniformly strung pattern, or by eliminating some of the main and/or cross strings farthest from the center of the striking surface, i.e., those closest to the frame. Although such non-uniform stringing patterns have been found to improve the playing characteristics of the racket in certain desirable ways, as for example by increasing the size of the "sweet spot", i.e., the area in which contact of the strings with the ball produces a minimum jarring impact on the arm of the user, they also present certain practical disadvantages. In those rackets in which increased density in the center of the striking surface is achieved by removing peripheral strings, the remaining strings must have increased tension and are subject to increased wear, leading to early failure. On the other hand, when additional strings are used to increase the density in the center of the striking surface, particularly in the case of rackets having wooden frames provided with holes through which the strings pass, the closely spaced holes required to accommodate the additional strings weaken the frame and lead to premature failure in play.

As a solution to one of the problems noted above, i.e., the weakening effect on the frame of a wooden racket created by the holes in the frame required for stringing, there have been proposals, exemplified by U.S. Pat. Nos. 455,632, and 4,118,029, British Pat. Nos. 6475 and 300,700 and French Pat. Nos. 550,985 and 855,902, to pass the ends of an adjacent pair of main or cross strings through single holes in the frame, thereby reducing the total number of holes required to accommodate a given number of main or cross strings. In French Pat. Nos. 855,902, it has been proposed to eliminate the use of holes entirely and to wrap the strings continuously around the outer circumference of the frame in a zigzag fashion, the strings being maintained in proper location by grooves on the outer circumference of the frame, adjacent strings being connected to a single attaching point at one of their respective ends and to different attaching points at their other ends. These proposals similarly present practical difficulties which have militated against their widespread use, among them being difficulty in stringing the racket and the necessity of using overlapping double lengths of stringing material between some adjacent holes on the outer surface of the frame. Not only does such stringing create areas of unequal stress in the frame, but the groove commonly provided in the outer surface of the wooden racket to receive the connecting lengths of stringing material, intended to avoid contact of the strings with the ground, also must be made twice as large, thereby further weakening the frame at these points. In addition, the overlapping of the interconnecting lengths of stringing material tends to crush the material, thus tending to reduce its durability and to lead to premature failure.

U.S. Pat. Nos. 3,086,777 and 3,206,203 disclose rackets employing a frame made of steel tubing which is unperforated and therefore not weakened by the presence of holes for securing the strings. In the rackets disclosed in these patents, the strings are secured to a serrated annular member or crown which is itself attached to the inner periphery of the frame by a resilient member such as a helical wire. While such tennis rackets have met with substantial commercial success and have been marketed in large numbers, there has been some dissatisfaction with the resiliency of the strung surface. Attempts to improve the resiliency of such rackets by providing additional string density in the center of the strung surface, in accordance with prior suggestions, have presented practical problems, in that the stiff wire forming the crown is not sufficiently deformable to permit the formation of additional serrations to allow additional strings.

SUMMARY OF THE INVENTION

In accordance with the invention, there is provided a racket for tennis and similar games in which the density of the strings in the central part of the strung surface is increased in a manner which substantially overcomes the problems heretofore encountered in achieving this result. The racket of the invention provides an increased density of strings by incorporating a middle zone formed of a continuous length of stringing material, in which zone the strings are arranged in a pattern such that, at one of their ends, an adjacent pair of strings is immobilized relative to the frame at a common fixing point, e.g., a hole in the frame of a wooden racket, or a serration in the annular crown of a metal racket, while at their respective other ends, the strings are affixed to different fixing points. Contrary to the construction found in rackets of the prior art in which a similar stringing arrangement was used, the pairs of strings having a common fixing point are not directly interconnected at the common fixing point, i.e., a path between one string affixed to a fixing point to which a second string is also affixed cannot be traced between the first string and the second string without passing through another fixing point.

In achieving the stringing pattern of the invention, the stringing material passes consecutively from a first fixing point on one side of the frame to a second fixing point on the other side of the frame, then to a third fixing point adjacent said second fixing point on the other side of the racket and back to the first fixing point. Accordingly, there is no direct connection between the strings at their common fixing point. In addition, in the stringing pattern of the invention, only one interconnecting length of stringing material extends between adjacent fixing points.

The stringing pattern used in the racket of the invention produces the desired increased density of stringing in the center of the striking surface while avoiding the disadvantages present in stringing of this type in the rackets of the prior art. The use of common fixing points, i.e., holes, in wooden frames, for adjacent pairs of strings reduces the required number of holes and thus increases the strength of the frame. The stringing pattern of the invention also eliminates the necessity for double lengths of stringing on the outside of the frame between adjacent holes, and thus effectively distributes the stress in the frame in a more uniform manner around the periphery thereof while also eliminating crushing of the strings and the necessity for an extra-large groove in the outer periphery of the frame required to countersink the external strings in the conventional manner. In metal frames employing an annular crown, the stringing pattern of the invention permits the fixing points, e.g., serrations, to be more widely spaced, thus facilitating the construction of the annular crown and also reducing the angle at which the strings are attached to the crown, thereby reducing the likelihood of string breakage.

Other advantages of the racket of the invention will be apparent from the following detailed description thereof, taken in conjunction with the accompanying drawings.

DETAILED DESCRIPTION OF THE PREFERRED EMBODIMENTS

Figure 1:
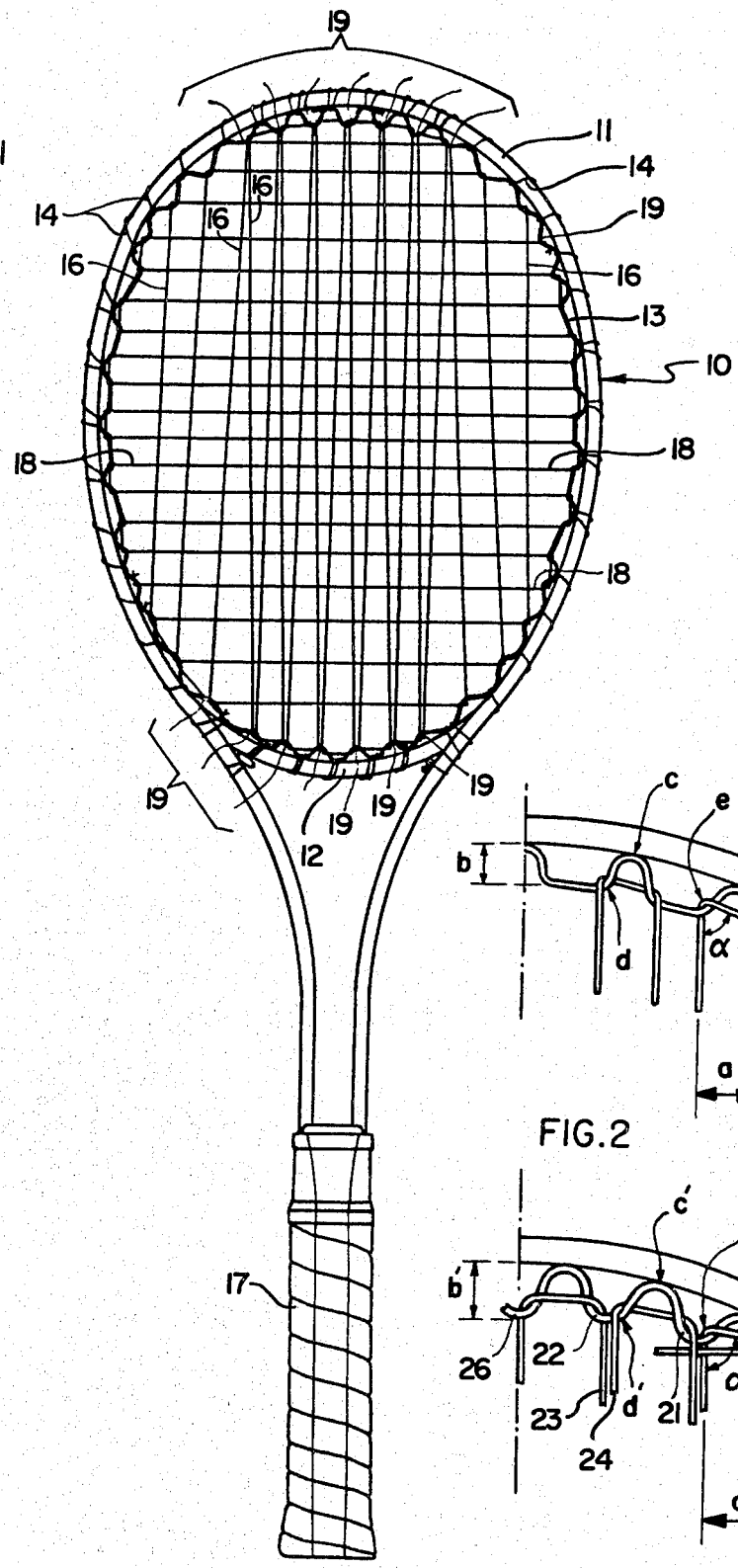
FIG. 1 shows a tennis racket of the type employing a metal frame and an annular crown, incorporating the stringing pattern of the invention in the main strings.

In FIG. 1, there is shown a racket 10 similar to those disclosed in U.S. Pat. Nos. 3,086,777 and 3,206,203, comprising an oval frame 11 formed of unperforated metal tubing, with a small length of the same tubing serving as a brace 12 in the open throat area of the racket. Attached to the inner periphery of the frame is an indented or serrated crown 13 fastened to the frame by wrappings of a steel wire 14, as in the prior art. The racket of FIG. 1 contains a conventional number (18) of main strings 16 running generally parallel to the axis of the racket through its handle 17 and a plurality of spaced cross strings 18 running generally perpendicular to the main strings. In common with other strung rackets, the ends of each string engage fixing means associated with the frame which immobilize or fix the ends of the string relative to the frame. In the case of wooden rackets, typical fixing means are holes in the frame through which the strings pass. In the metal racket shown in FIG. 1, the fixing means consist of the bottoms of the individual indentations or serrations 19 of crown 13, i.e., the portions farthest away from frame 11, e.g., 21 in FIG. 2. Each end of the strings engages such a serration and, when the strings are under tension, movement of the end of the string relative to the frame is effectively inhibited.

The stringing shown in FIG. 1 does not follow the traditional pattern in which each string engages a single fixing point at each end. Rather, in a zone in the middle of the strung pattern, i.e., closest to the axis of handle 17, the main strings are arranged in a manner such that each of a pair of adjacent strings engages a common fixing point at one end while each of the other ends engages a different fixing point. It should be further noted, however, that two strings having a common fixing point are not interconnected at the fixing point. In other words, a string entering a fixing point is not merely reversed at the common fixing point to travel in the opposite direction, but rather each string entering a common fixing point passes to a different adjacent fixing point before reversing its direction to the other side of the frame. Thus, for example, at serration 22 in FIG. 2, string 23 is not connected to string 24, but rather after engaging serration 22, proceeds to adjacent serration 26, whereas string 24 proceeds to adjacent serration 21. The same arrangement also exists at each of the other fixing points to which are affixed the ends of two strings.

Figure 3:
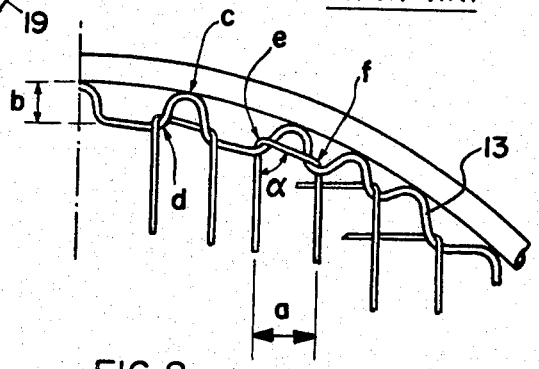
FIG. 3 PRIOR ART
FIG. 3 is a detail of a similar section of a prior art racket showing the stringing pattern conventionally employed in metal rackets of this type.
Figure 2:
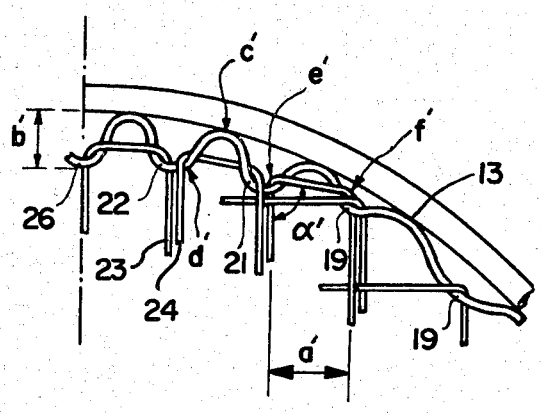
FIG. 2 is a detail of a section of the frame of the racket in FIG. 1, showing the stringing pattern of the invention.

It will be seen, by comparing FIG. 3 showing the arrangement used in the prior art with that of FIG. 2 in accordance with the invention, that because of the stringing arrangement employing common attaching points for two strings, the transverse distance (a', FIG. 2) between adjacent attaching points is greater than would otherwise be the case (a, FIG. 3) if individual attaching points were used for each string. It is also apparent that because of the stringing pattern, the density of main strings in the middle zone of the strung surface is increased, the distance between adjacent main strings in the middle zone being less than that of the stringing adjacent the sides of the frame.

While the expected advantages of the increased density of stringing have been confirmed in play, in that users of the racket find the size of the "sweet spot" to have been increased as expected, other, non-obvious, advantages of the construction of the invention have also been found. In the prior art, as exemplified in FIG. 3, because of the relatively narrow spacing between adjacent strings, the effective width of each serration or tooth, e.g., a, is smaller than that (a', FIG. 2) in the present invention. Similarly, because of the necessary stiffness of the wire crown 13, the effective depth b (FIG. 3) of each tooth is less than that of the corresponding depth b' of the present invention. The increased width and depth of the teeth of the crown in the present invention gives rise to several advantages. The likelihood of breakage of a string at a fixing point is affected by the size of the angle through which the string is deflected as it leaves the fixing point, the greatest incidence of breakage occurring when the string is caused to reverse its direction around a supporting member of narrow dimension, such as would occur if strings 23 and 24 were interconnected at the bottom of serration 22 (FIG. 2). The increased width and depth of the teeth in the crown 13 of the present invention results in a decrease in the angle through which a string is bent as it passes through the fixing point, thus reducing the likelihood of string breakage. Note the relatively large supplement (angle a') of the angle through which string 24 in FIG. 2 is bent, i.e., $180°-\alpha'$, with the corresponding smaller supplement $\alpha$ in FIG. 3, indicating less string bending in FIG. 2 than in FIG. 3. Further the increased length of wire between the top and the bottom of each tooth, e.g., c'-d' (FIG. 2), compared with the corresponding dimension c-d in FIG. 3, provides a desirable increase in the resiliency of the string-supporting crown 13. Similarly, the increased length of string e'-f' (FIG. 2) compared with e-f in FIG. 3 also decreases the likelihood of breakage at these points either during stringing of the racket or during play.

The increased resiliency of strung surfaces made in accordance with the invention has also been confirmed by laboratory tests of a racket similar to that of FIG. 1, in comparison with a commercial racket (FIG. 3) of the same weight and strung with the same gut stringing material under the same tension. In tests wherein the rackets were used to strike tennis balls, the speed of the racket head being measured at the moment of impact, it was found that the rebounding speed of the ball after impact relative to that of the head, was substantially greater for the racket of the invention than that of the commercial model.

Figure 4:
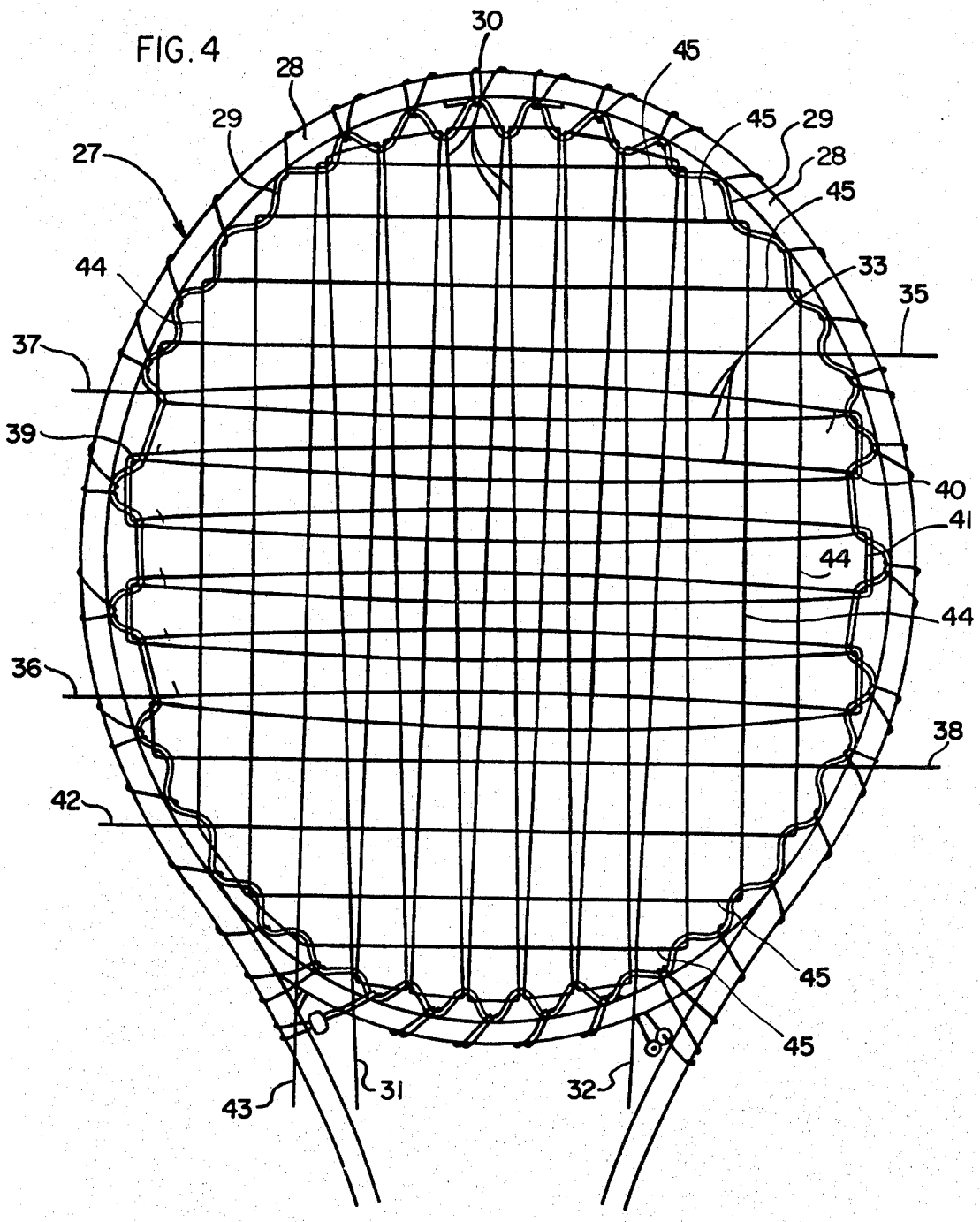
FIG. 4 shows a metal racket similar to that of FIG. 1, with the addition of pairs of cross strings having common fixing points at their ends.

Another embodiment of the invention in a racket 27 having a metal frame 28 and a serrated crown 29 is shown in FIG. 4. The main strings 30 in the middle portion of the strung surface are formed, as in the embodiment of FIG. 1, from a single piece of stringing material, the ends of which are identified by reference numerals 31 and 32. It will be understood that ends 31, 32 are secured to the racket frame in conventional fashion, not shown. In FIG. 4, the density of the strung surface has been further increased in the central portion thereof by providing a central zone of cross strings 33 formed of two lengths of stringing material having ends 35, 36 and 37, 38 respectively, in which adjacent pairs of strings are affixed to common fixing points, e.g., 39 and 40. It will be noted in FIG. 4 that at certain teeth of crown 29, e.g., 41, two lengths of stringing material pass between adjacent fixing points. Although this is disadvantageous as compared with the stringing of the main strings, in which only a single length of string passes between adjacent fixing points, any resulting disadvantage may be more than compensated for by the increased size and resiliency of the "sweet spot", factors which may be of particular concern to advanced players.

The stringing of the racket shown in FIG. 4 is completed by an auxiliary length of stringing material having ends 42, 43, which provides both main and cross strings, e.g., 44 and 45, at the periphery of the strung surface.

Figure 5:
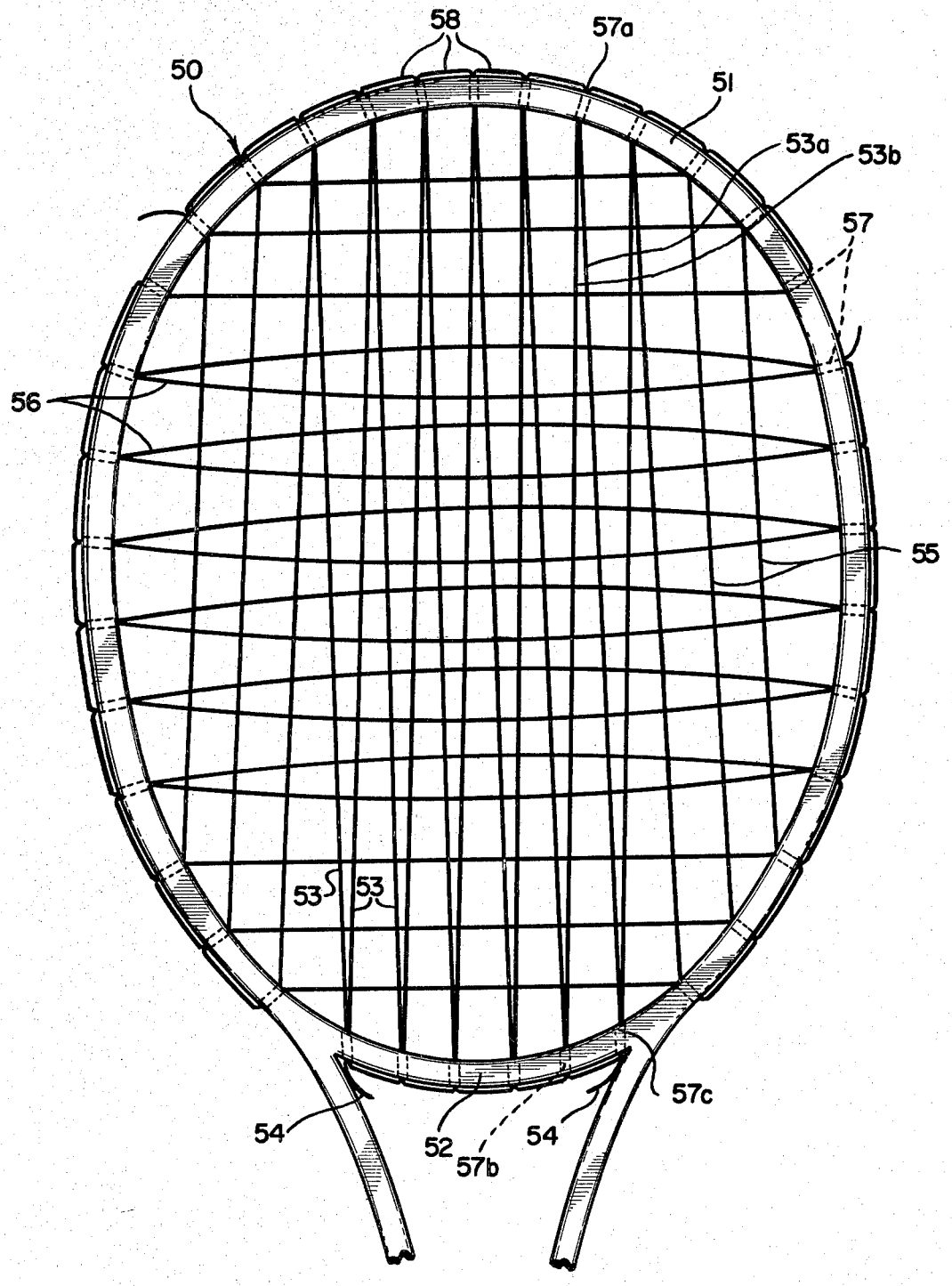
FIG. 5 shows a racket having a pattern similar to that of FIG. 4 in which the fixing points are holes in the frame.
Figure 6:
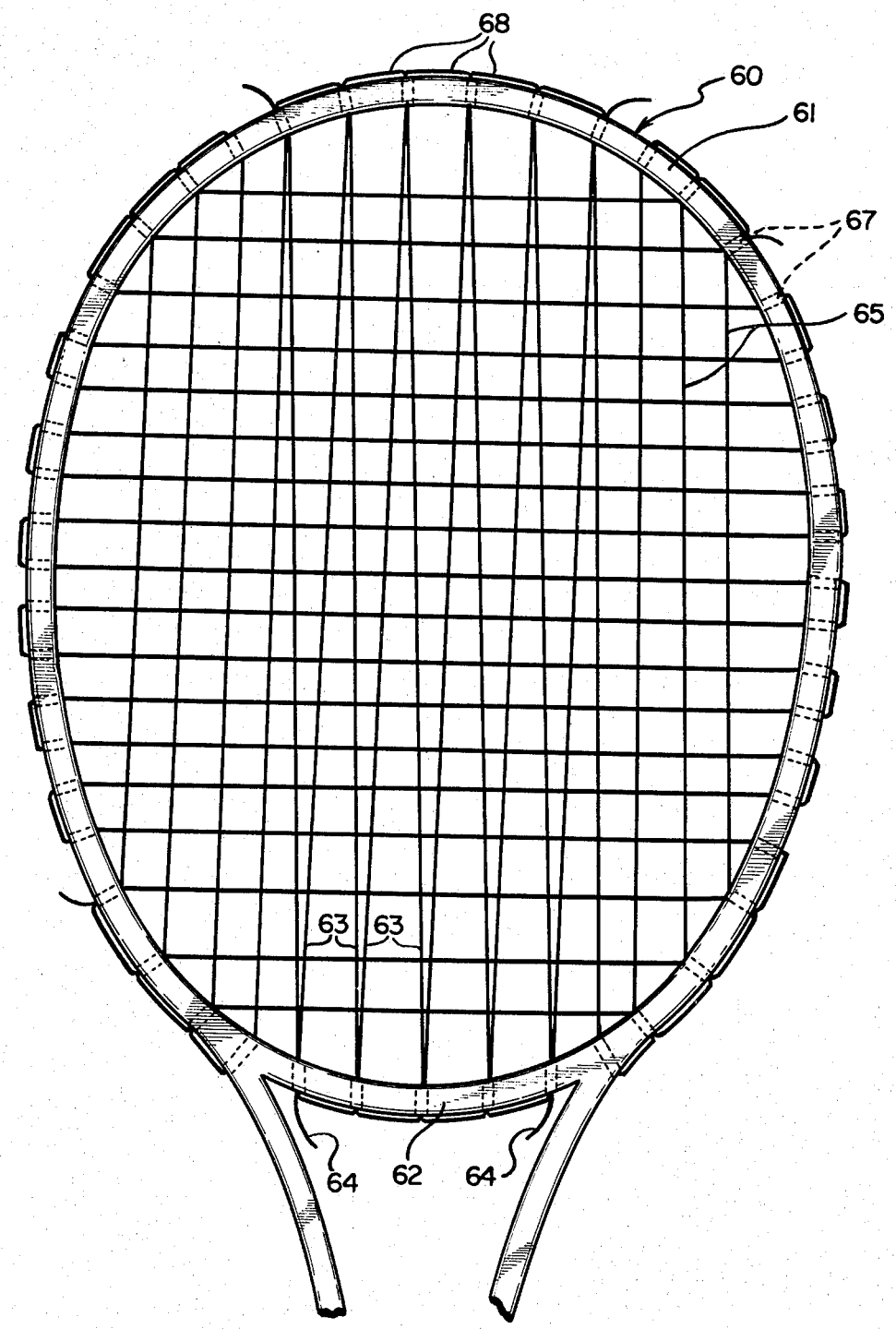
FIG. 6 shows a tennis racket having an open throat, incorporating the stringing pattern of the invention in the main strings, in which holes in the frame provide fixing points for the strings.
Figure 7:
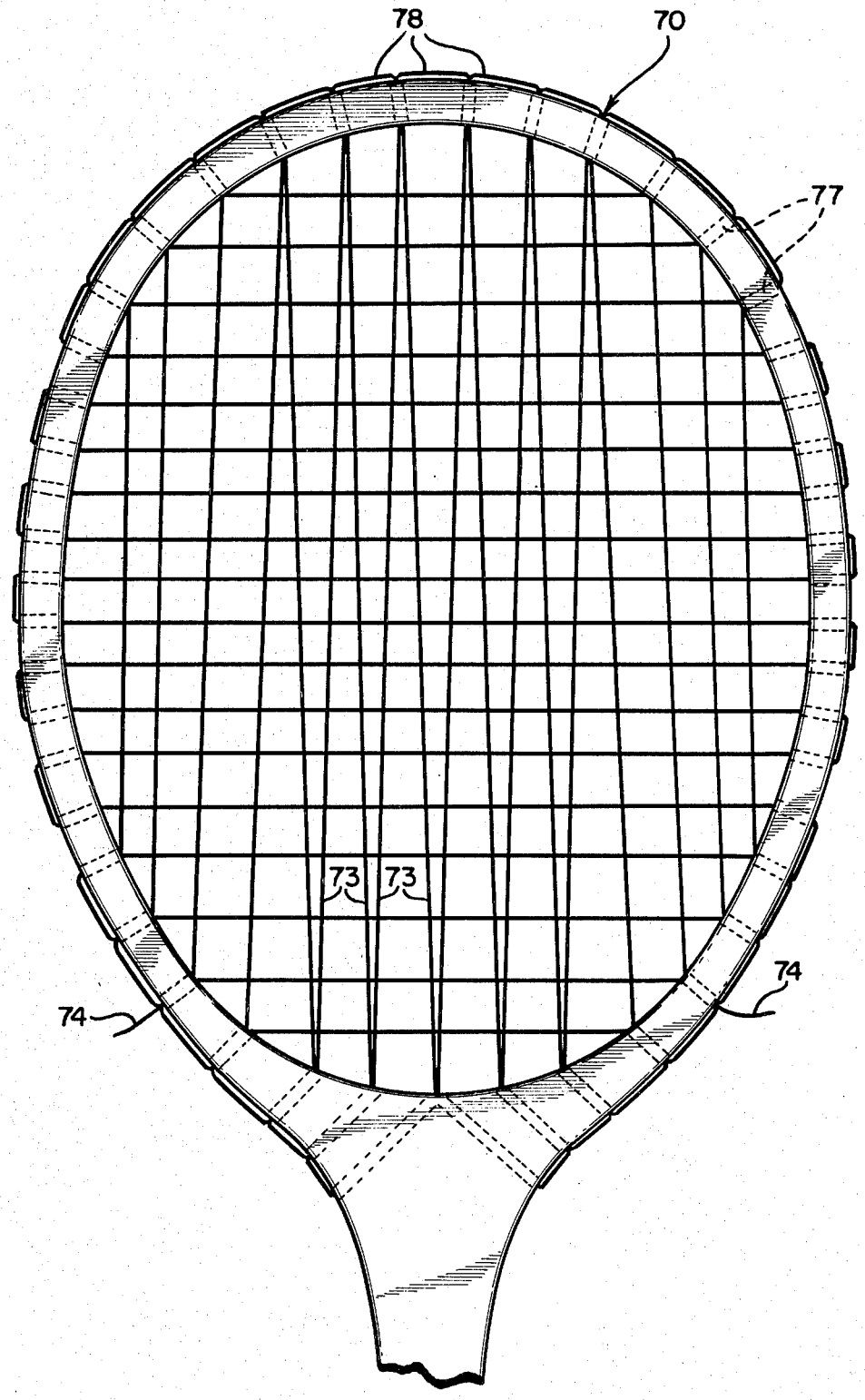
FIG. 7 shows a racket having a stringing pattern similar to that of FIG. 6 in a racket having a solid throat.

The application of the invention to rackets in which the fixing points consist of holes in the frame through which the strings are passed is shown in FIGS. 5, 6 and 7. The rackets 50 and 60 shown in FIGS. 5 and 6 respectively, have frames 51 and 61 made of steel tubing with braces 52 and 62 in the area of the throat, similar to the racket shown in FIG. 1. Frames 51 and 61 may be made of any suitable material such as wood, aluminum or composite, e.g., plastic, material. The racket 70 shown in FIG. 7, having a closed throat and no brace, is typically made of wood but could also be made of metal or other appropriate materials.

Figure 10:
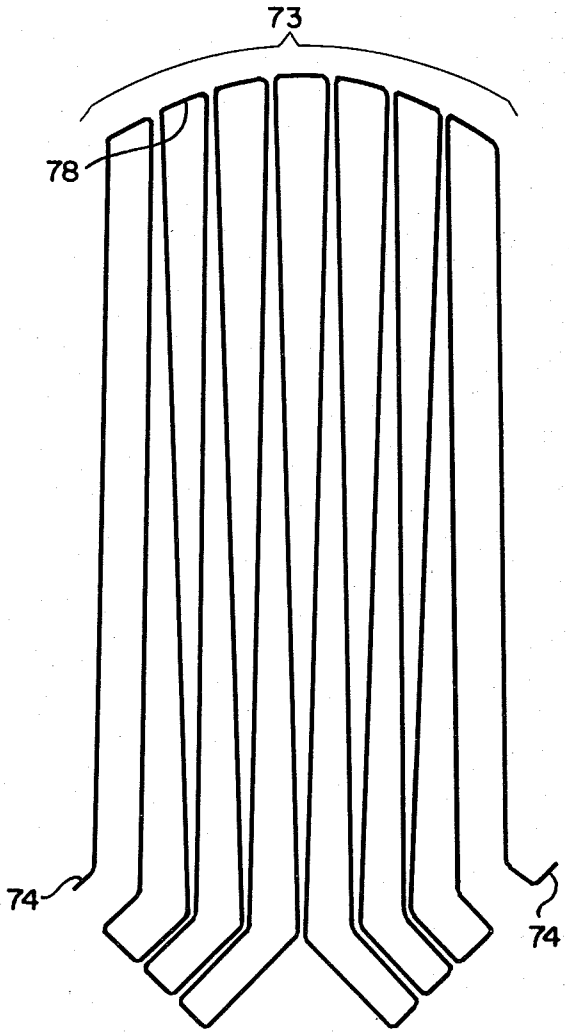
FIG. 10 shows a portion of the main stringing pattern in the racket of FIG. 7.
Figure 9:
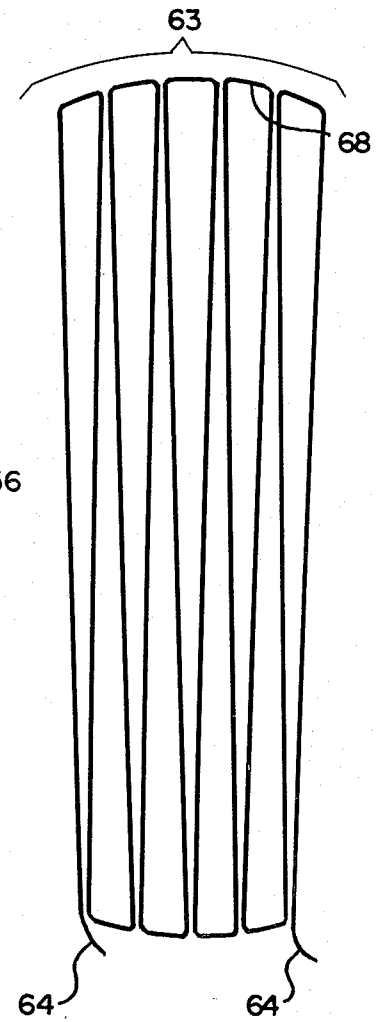
FIG. 9 shows a portion of the main stringing pattern in the racket of FIG. 6.
Figure 8:
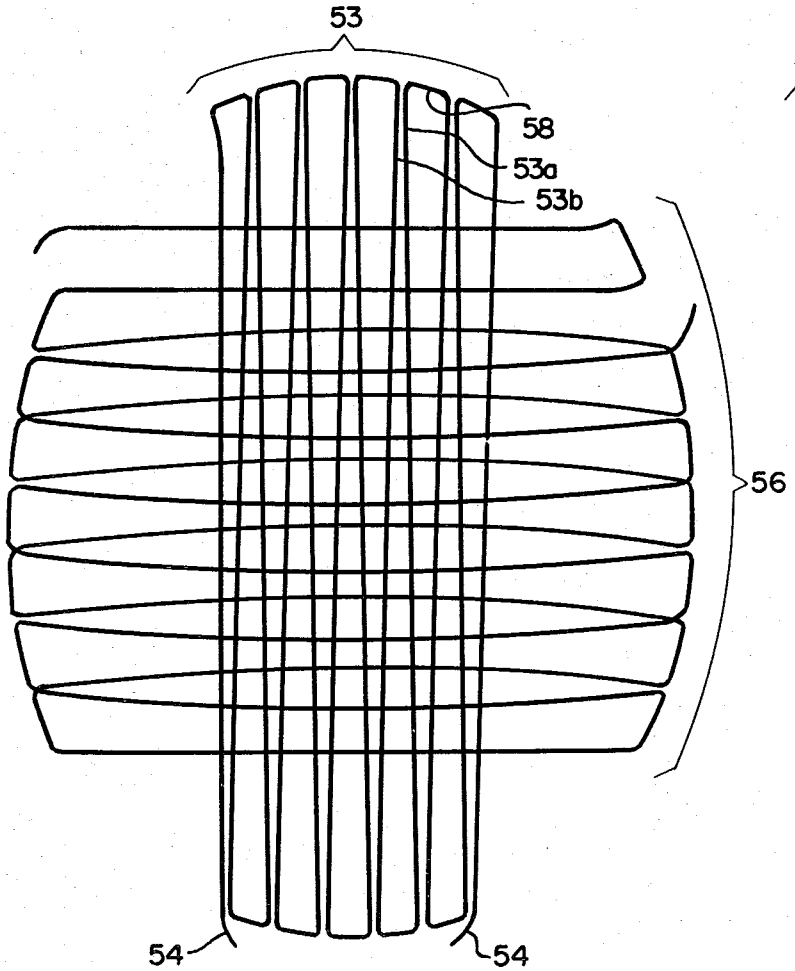
FIG. 8 shows portions of the main and cross stringing patterns used in the racket of FIG. 5.

Portions of the stringing patterns employed in the rackets of FIGS. 5, 6 and 7 are shown in FIGS. 8, 9 and 10 respectively. It will be seen that in FIGS. 8 and 9, a middle zone 53, 63, of the main strings is formed of a single continuous length of stringing material, having ends 54 and 64, respectively. The peripheral main strings, e.g., 55 and 65 (FIGS. 5 and 6), which are subject to less stress and wear than the main strings, can be formed in any appropriate manner. In FIGS. 5 and 8, the central portion 56 of the cross strings is similarly formed from a single length of stringing material. The remaining peripheral cross strings in FIG. 8 and all of the cross strings in FIGS. 9 and 10 (not shown) can be supplied in conventional fashion.

It will be seen that the main stringing pattern employed in FIGS. 5, 6 and 7 corresponds generally to that previously described in connection with FIGS. 1 and 3, the major difference being that in the rackets of FIGS. 5, 6 and 7, holes in the frame, e.g., 57, 67, 77, rather than the bottoms of serrations in a crown provide fixing points for the ends of the individual strings. It will also be seen that although two adjacent strings, e.g., **53*a*, 53*b* (FIGS. 5, 8) enter a common fixing point, e.g., 57*a*, at one of their ends, the other ends of the strings are affixed to different fixing points 57*c* and 57*b*, respectively and further that at any common fixing point there is no connection between the strings, each of which passes to an adjacent fixing point before reversing direction. It will also be noted that there is a single length of stringing material, e.g., 58, 68, 78**, between adjacent fixing points, which passes along the outer periphery of the frame. The stresses imparted to the frame through the strings are accordingly more evenly distributed around the periphery of the frame, rather than being concentrated at certain points where the interconnecting strings are doubled between adjacent holes, as in the prior art.

The single interconnections 58, 68, 78 between adjacent holes in the rackets of the present invention provide still another advantage over the prior art. It is common practice in the manufacture of wooden rackets to countersink the external lengths of strings on the outer periphery of the racket into the frame, particularly at the end of the racket opposite the handle, in order to avoid contact of the stringing material with the ground. When double lengths of stringing exist between adjacent holes, the groove required to accommodate the double lengths must be made larger in order to accommodate the double strings, thereby creating localized points of weakness in the frame which increase the likelihood of breakage in play. By contrast, in the present invention, only a relatively shallow groove, sufficient to accommodate a single string, is required, thus appreciably adding to the durability of the frame.

Although the stringing pattern of the invention is particularly useful in the main strings of a racket, it should be understood that it can also be used to advantage in forming the cross strings thereof.

The foregoing detailed description has been given for clearness of understanding only, and no unnecessary limitation should be understood therefrom as modifications will be obvious to those skilled in the art.

What is claimed is:

1. In a racket for tennis and similar games comprising a handle; a generally oval frame attached to said handle; a striking surface comprising a plurality of spaced main strings extending across said frame in a direction generally parallel to the axis of said handle and a plurality of spaced cross strings extending across said frame in a direction generally perpendicular to said main strings; a middle zone in the central part of the striking surface in which the density of the strings is increased by a predetermined stringing pattern; and fixing means associated with said frame providing a plurality of spaced fixing points at which the respective ends of said strings are fixed relative to said frame when said strings are under tension; the improvement wherein:

said middle zone includes a plurality of said main strings or said cross strings, the strings in said zone being formed of a continuous length of stringing material arranged in said predetermined pattern in which said stringing material passes consecutively from a first fixing point on one side of said frame to a second fixing point on the other side of said frame, then to a third fixing point adjacent said second fixing point on said other side, and back to said first fixing point, each of a pair of adjacent strings in said zone engages a common fixing point at one of their respective ends, and passes to different adjacent fixing points before reversing their direction to the other side of the frame to different fixing points at their other respective ends, and wherein only a single length of said stringing material passes directly between any two adjacent fixing points in said middle zone.

2. A racket in accordance with claim 1 wherein said fixing means comprises a plurality of holes in said frame, through which said stringing material passes.

3. A racket in accordance with claim 1 wherein said middle zone comprises main strings, and at least some of said cross strings are arranged in pairs between common fixing points.

4. A racket in accordance with claim 1 wherein said fixing means comprises a serrated wire crown affixed to the inner periphery of said frame, said crown having a plurality of serrations, the bottoms of which provide said fixing points.

* * * * *

UNITED STATES PATENT AND TRADEMARK OFFICE

CERTIFICATE OF CORRECTION

PATENT NO. : 4,366,959

DATED : January 4, 1983

INVENTOR(S) : FRANCOIS R. LACOSTE

It is certified that error appears in the above-identified patent and that said Letters Patent are hereby corrected as shown below:

Column 5, line 14, "(angle a')" should be

--(angle α')--.

Signed and Sealed this

*Fifteenth* Day of *November 1983*

[SEAL]

*Attest:*

GERALD J. MOSSINGHOFF

*Attesting Officer*

*Commissioner of Patents and Trademarks*